US011885318B2

(12) United States Patent
Leng et al.

(10) Patent No.: US 11,885,318 B2
(45) Date of Patent: Jan. 30, 2024

(54) PISTON PUMP WITH TWO MOTOR STATORS AND ONE MOTOR ROTOR HAVING CAM DRIVING PISTON AND FLOW DISTRIBUTOR

(71) Applicants: HANGZHOU CITY UNIVERSITY, Hangzhou (CN); ZHEJIANG UNIVERSITY, Hangzhou (CN); WENZHOU UNIVERSITY, Wenzhou (CN)

(72) Inventors: Longlong Leng, Hangzhou (CN); Qiang Zuo, Hangzhou (CN); Qilin Jin, Hangzhou (CN); Yan Ren, Wenzhou (CN); Zhuhua Deng, Hangzhou (CN); Wei Shao, Hangzhou (CN); Quankun Li, Hangzhou (CN); Pengfei Wang, Hangzhou (CN); Zheng Wang, Hangzhou (CN); Liying Lou, Hangzhou (CN); Yanwei Zhao, Hangzhou (CN)

(73) Assignees: HANGZHOU CITY UNIVERSITY, Hangzhou (CN); ZHEJIANG UNIVERSITY, Hangzhou (CN); WENZHOU UNIVERSITY, Wenzhou (CN)

( * ) Notice: Subject to any disclaimer, the term of this patent is extended or adjusted under 35 U.S.C. 154(b) by 0 days.

(21) Appl. No.: 18/314,824

(22) Filed: May 10, 2023

(65) Prior Publication Data

US 2023/0374978 A1 Nov. 23, 2023

(30) Foreign Application Priority Data

May 19, 2022 (CN) ..... 202210541713.3

(51) Int. Cl.
*F04B 23/06* (2006.01)
*F04B 17/03* (2006.01)
(Continued)

(52) U.S. Cl.
CPC ..... *F04B 17/03* (2013.01); *F04B 23/06* (2013.01); *F04B 7/003* (2013.01); *F04B 7/0023* (2013.01); *F04B 7/06* (2013.01); *F04B 9/04* (2013.01)

(58) Field of Classification Search
CPC ..... F04B 7/0007; F04B 7/0015; F04B 7/003; F04B 7/0023
See application file for complete search history.

(56) References Cited

U.S. PATENT DOCUMENTS 5,741,126 A * 4/1998 Stearns ..... F04B 7/04 417/500
10,393,096 B2 * 8/2019 Beard ..... F16K 11/0856
2007/0296281 A1 * 12/2007 Choi ..... H02K 16/00 310/12.14

FOREIGN PATENT DOCUMENTS

CN 1651760 A 8/2005
CN 102052216 A 5/2011
(Continued)

*Primary Examiner* — Nathan C Zollinger
*Assistant Examiner* — Timothy P Solak

(57) ABSTRACT

A two-dimensional motor combination piston pump by combining two independent two-dimensional piston pumps into one structure is provided. The combination piston pump includes a two-dimensional motor and a two-dimensional piston pump. The outer rotator serves as the piston and the flow distribution mechanism of the two-dimensional piston pump. While operating, outer rotator rotates and moves axially.

5 Claims, 2 Drawing Sheets

(51) Int. Cl.

| | |
|---|---|
| *F04B 7/00* | (2006.01) |
| *F04B 7/06* | (2006.01) |
| *F04B 9/04* | (2006.01) |

(56) References Cited

FOREIGN PATENT DOCUMENTS

| | | | |
|---|---|---|---|
| CN | 106795872 | A | 5/2017 |
| CN | 108290562 | A | 7/2018 |
| CN | 207974934 | U | 10/2018 |
| CN | 110145448 | A | 8/2019 |
| CN | 112832977 | A | 5/2021 |
| CN | 113162313 | A | 7/2021 |
| DE | 19806077 | A1 | 6/1999 |

* cited by examiner

PISTON PUMP WITH TWO MOTOR STATORS AND ONE MOTOR ROTOR HAVING CAM DRIVING PISTON AND FLOW DISTRIBUTOR

CROSS REFERENCE

The present application claims foreign priority of Chinese Patent Application No. 202210541713.3, filed on May 19, 2022, in the China National Intellectual Property Administration, the entire contents of which are hereby incorporated by reference in its entirety.

TECHNICAL FIELD

The present disclosure relates to the field of motors and fluid driving, and in particular to a two-dimensional motor combination piston pump including a two-dimensional motor and a two-dimensional piston pump.

BACKGROUND

An electric motor is a component that converts electrical energy into mechanical energy to provide power, and serves as a power source for pumps. An external rotor motor is a motor in which the coil is located on the stator and the permanent magnet is on the outer rotor. Compared to ordinary motors, the rotor of a two-dimensional motor can conduct some axial movement while conducting rotational movement. A hydraulic pump is a hydraulic component that provides pressurized fluid in a hydraulic system, and is a conversion device that converts mechanical energy from an electric motor or internal combustion engine into hydraulic energy. A piston pump makes the working volume of a pump volume chamber change periodically to achieve the suction and discharge of liquid, by means of the reciprocating motion of the piston. Compared with ordinary piston pumps, a two-dimensional piston pump uses the two-dimensional motion conversion mechanism in which a piston part conducts two-dimensional motion of rotation and axial direct movements, which simultaneously realizes the function of oil suction and discharge and the function of flow distribution, thereby improving the volumetric efficiency and integration; the two-dimensional piston pump can continuously suck and discharge oil for many times with one rotation of the piston, which improves the power density.

The inventor of the present disclosure finds in the long-term research and development that for the two-dimensional piston pump currently in the art, the motor shaft is connected to the shaft of the piston, such that the motor drives the piston to rotate and to move axially due to the action of the cam. Therefore, there are problems such as the motor shaft is subjected to axial force with high mechanical wear and tear, and the motor heats up seriously when running at high speed for a long time.

SUMMARY OF THE DISCLOSURE

The present disclosure provides a two-dimensional motor combination piston pump, in order to solve the technical problems of the prior art in the two-dimensional piston pump motor such as the motor shaft is subjected to axial force with high mechanical wear and tear, and the motor heats up seriously when running at high speed for a long time.

In an aspect, the present disclosure provides a two-dimensional motor combination piston pump, including a two-dimensional motor and a two-dimensional piston pump. The two-dimensional motor and the two-dimensional piston pump are nested with each other and arranged coaxially. The two-dimensional motor comprises two stators and one outer rotor, the two stators are distributed symmetrically, the outer rotor is coaxial with the two stators and sleeves outside of the two stators. The two-dimensional piston pump comprises a flow distribution mechanism, the flow distribution mechanism comprises a flow distribution rotor and a pump body. The two-dimensional piston pump comprises a piston mechanism, the piston mechanism comprises a left cam and a right cam; the left cam is fixedly connected to a left end surface of the flow distribution rotor through a second positioning pin, the right cam is fixedly connected to a right end surface of the flow distribution rotor through another second positioning pin; a middle of an inner side of the flow distribution rotor is arranged with an annular shoulder; an inner diameter of the shoulder, an inner diameter of the left cam, and an inner diameter of the right cam are equal to each other; an inner surface of the shoulder of inside the flow distribution rotor, the left cam, and the right cam form gap seals with outer surfaces of a left stator and a right stator of each of the two stators to further form a first volume chamber, a second volume chamber, a third volume chamber, and a fourth volume chamber cooperatively with the flow distribution rotor. The two-dimensional piston pump comprises a roller assembly, and the roller assembly further comprises a roller and a roller shaft, the roller assembly is fixed to an outside of the stator, the roller contacts a convex surface and a concave surface of the left cam and the right cam. The two-dimensional piston pump comprises a pump housing, a left end cover, and a right end cover, the pump housing sleeves an outside of the pump body and defines a first flow channel port, a second flow channel port, a third flow channel port, and a fourth flow channel port, the first flow channel port is communicated with a first annular groove of the pump body, the second flow channel port is communicated with a second annular groove of the pump body, the third flow channel port is communicated with a third annular groove of the pump body, the fourth flow channel port is communicated with a fourth annular groove of the pump body; the left end cover covers a side of the pump housing, the right end cover covers the other side of the pump housing, the pump housing, the two stators, and the roller assembly are fixed engaged with each other.

In some embodiments, each of the two stators comprises a left stator, a right stator, a stator coil, a wire, and a controller. An end of the left stator is arranged with a fine shaft, the fine shaft has a pin slot. The left stator and the right stator are co-axially arranged and a circumferentially fixed with each other through a pin. The stator coil 13 comprises windings, a retaining bracket and a silicon steel sheet, the stator coil defines a core hole, the core hole extends through the fine shaft and is located between the left stator and the right stator, the stator coil is coaxially and fixedly connected to the left stator and the right stator through a first positioning pin. The wire and the controller are drawn out through a hole in a shaft of the left stator.

In some embodiments, the outer rotator includes: the flow distribution rotor, coaxially sleeves the outside of the two stators; a plurality of permanent magnets, wherein the plurality of permanent magnets are fixedly arranged on an inner wall of the flow distribution rotor and are spaced apart from each other; and the left cam and the right cam, wherein the left cam is fixedly connected to the left end surface of the flow distribution rotor through the second positioning pin, the right cam is fixedly connected to the right end surface of the flow distribution rotor through the another second positioning pin.

In some embodiments, the flow distribution rotor is central-symmetric. An outer surface of the flow distribution rotor defines eight grooves, four of the eight grooves are located on a left side of the flow distribution rotor, and the rest four of the eight grooves are located on a right side of the flow distribution rotor, the four grooves on the left side of the flow distribution rotor and the four grooves on the right side of the flow distribution rotor are symmetrically distributed. Each groove occupies 45° in circumferential width, the four grooves on the same side overlap by a certain length in an axial direction. A set of two opposite grooves on the left side of the flow distribution rotor serve as a first groove, extending outward to reach an end face, another set of two opposite grooves on the left side of the flow distribution rotor serve as second groove, extending In some embodiments, the pump body defines four annular grooves in a circumferential direction, the four annular grooves are symmetrical about a middle face, the four annular grooves are a first annular groove, a second annular groove, a third annular groove, and a fourth annular groove. Four evenly distributed through holes are defined between the first annular groove and the second annular groove, each of the four through holes occupies an angle of 45° in circumferential width. A set of two opposite through holes of the four through holes serve as a first through hole and communicate with the first annular groove, another set of two opposite through holes of the four through holes serve as a second through hole and communicate with the second annular groove. Four evenly distributed through holes are defined between the third annular groove and the fourth annular groove, each of the four through holes occupies an angle of 45° in circumferential width; a set of two opposite through holes of the four through holes serve as a third through hole and communicate with the third annular groove, and another set of two opposite through holes of the four through holes serves as a fourth through hole and communicate with the fourth annular groove.

BRIEF DESCRIPTION OF THE DRAWINGS

In order to more clearly illustrate the technical solutions in the embodiments of the present disclosure, the following is a brief description of the drawings used in the description of the embodiments, it is obvious that the drawings in the following description are only some of the embodiments of the present disclosure, and that other drawings can be obtained from these drawings without any creative work for a those skilled in the art.

Figure 1:
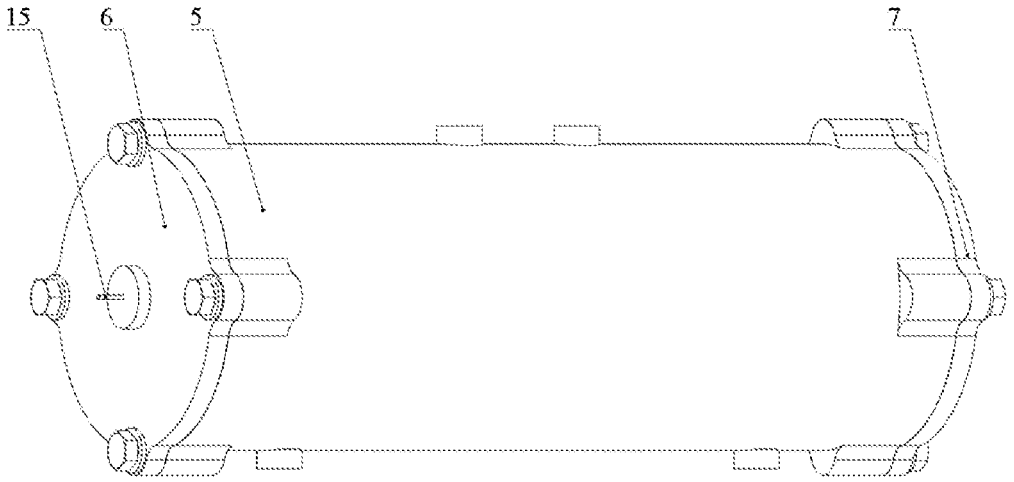
FIG. 1 is a perspective structural schematic view of a two-dimensional motor combination piston pump according to an embodiment of the present disclosure.

Reference numerals: 1. stator; 11. left stator; 111. fine shaft; 12. right stator; 13. stator coil; 131. core hole; 14. first positioning pin; 15. wire and controller; 2. outer rotor; 21. flow distribution rotor; 211. first groove; 212. second groove; 213. third groove; 214. fourth groove; 22. left cam; 23. right cam; 24. second positioning pin; 25. permanent magnet; 3. pump body; 311. first annular groove 312. second annular groove; 313. third annular groove; 314. fourth annular groove; 321. first through hole; 322. second through hole; 323. third through hole; 324. fourth through hole; 4. roller assembly; 41. roller; 42. roller shaft; 5. pump housing; 6. left end cover; 7. right end cover; V1. first volume chamber; V2. second volume chamber; V3. third volume chamber; V4. fourth volume chamber; A1. first flow channel port; A2. second flow channel port; A3. third flow channel port; A4. fourth flow channel port.

DETAILED DESCRIPTION

The technical solutions in the embodiments of the present disclosure will be clearly and completely described below with reference to the drawings in the embodiments of the present disclosure. Obviously, the described embodiments are only a part of the embodiments of the present disclosure, but not all of the embodiments. Based on the embodiments in the present disclosure, all other embodiments obtained by those skilled in the art without creative work fall within the scope of the present disclosure.

The terms "first" and "second" in the present disclosure are only used for descriptive purposes, and should not be construed as indicating or implying relative importance or implicitly indicating the number of indicated technical features. In the description of the present disclosure, "a plurality of" means at least two, such as two, three, etc., unless otherwise expressly and specifically defined. Furthermore, the terms "including" and "having" and any variations thereof are intended to cover non-exclusive inclusion. For example, a process, method, system, product, or device including a series of steps or units is not limited to the listed steps or units, but optionally further includes unlisted steps or units, or optionally further includes other steps or units that are inherent to the process, method, product, or device.

Figure 2:
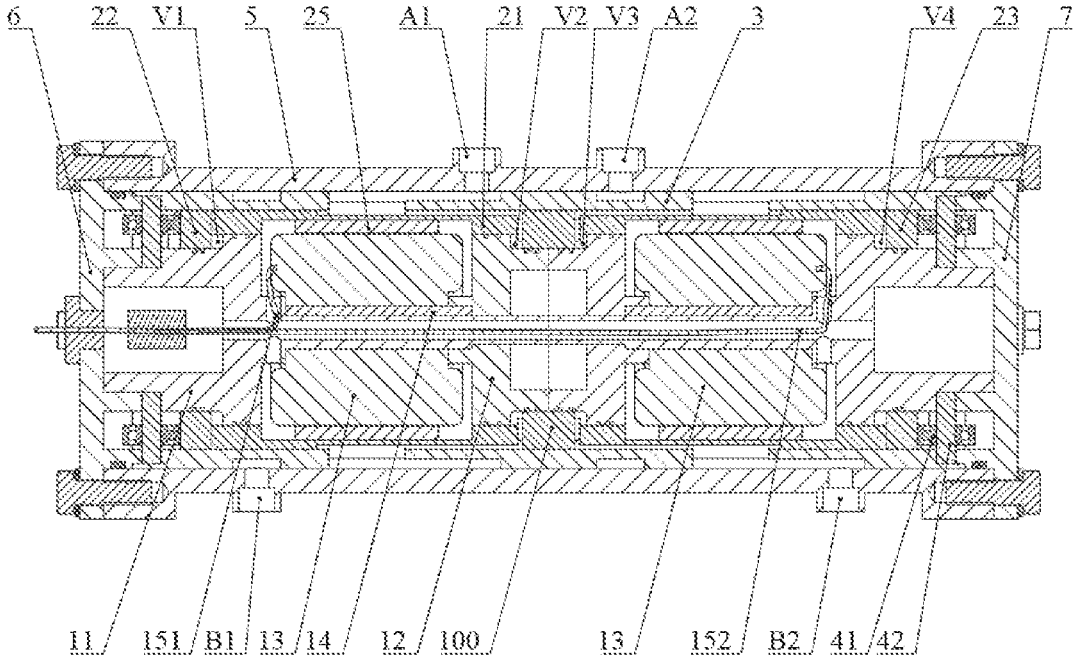
FIG. 2 is a cross-sectional structural schematic view of a two-dimensional motor combination piston pump according to an embodiment of the present disclosure.
Figure 3:
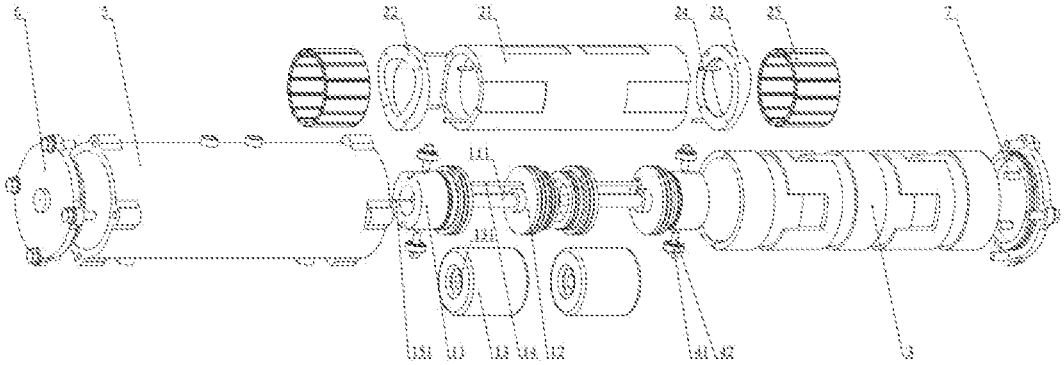
FIG. 3 is an exploded structural schematic view of a two-dimensional motor combination piston pump according to an embodiment of the present disclosure.
Figure 4:
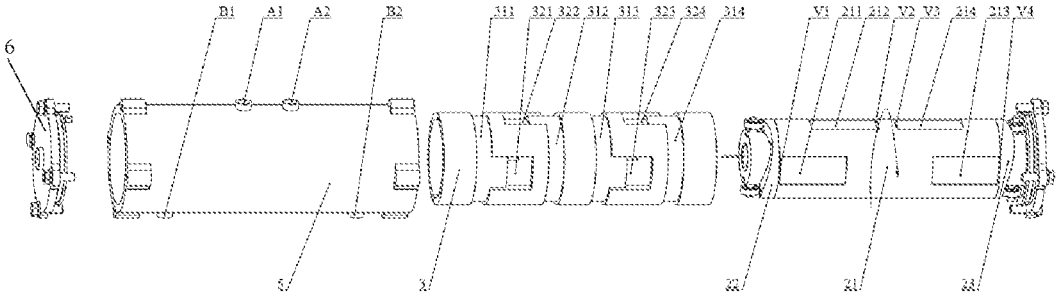
FIG. 4 is a schematic view of the two-dimensional motor combination piston pump sucking and discharging liquid according to an embodiment of the present disclosure.

The present disclosure proposes a two-dimensional motor combination pump, as illustrated in FIGS. 1-4, FIG. 1 is a perspective structural schematic view of a two-dimensional motor combination piston pump according to an embodiment of the present disclosure, FIG. 2 is a cross-sectional structural schematic view of a two-dimensional motor combination piston pump according to an embodiment of the present disclosure, FIG. 3 is an exploded structural schematic view of a two-dimensional motor combination piston pump according to an embodiment of the present disclosure, and FIG. 4 is a schematic view of operations of a two-dimensional motor combination piston pump sucking and discharging liquid according to an embodiment of the present disclosure.

The two-dimensional motor combination piston pump in the embodiments includes a two-dimensional motor and a two-dimensional piston pump. The two-dimensional motor and the two-dimensional piston pump are nested with each other and arranged coaxially. The two-dimensional motor includes two stators 1 and one outer rotor 2. The outer rotor 2 of the two-dimensional motor also serves as a piston and a flow distribution mechanism of the two-dimensional piston pump. The two stators 1, the outer rotor 2 (piston and flow distribution mechanism of the pump), a pump body 3, and a pump housing 5 of the two-dimensional motor are sequentially sleeved from an inside to an outside and are arranged coaxially. In a current two-dimensional piston pump, the motor shaft drives the piston to rotate and move axially through the action of the cam with the motor shaft and the shaft of the piston being shaft-connected. Therefore, there are problems such as the motor shaft is subjected to axial force with high mechanical wear and tear, and the motor heats up seriously when running at high speed for a long time. The motor in the present disclosure is a two-dimensional motor. During operation, the outer rotor 2 performs rotational movement, that is, the piston and the flow distribution mechanism of the pump perform rotational movement to realize the flow distribution function. In addition, two ends of the outer rotor 2 are respectively cam surfaces. Further, the two cam surfaces are a left cam 22 and a right cam 23. The left cam 22 and the right cam 23 are the same but are installed staggeredly at 180° and are in contact with a shaft-fixed roller 41. Therefore, when the outer rotor 2 rotates, an axial movement is generated to realize two-dimensional motion of a rotational movement around the axis and an axial movement. The outer rotor 2 also serves as the piston, and the axial movement may change a volume of each of the volume chambers V1, V2, V3, and V4, thereby realizing the functions of sucking and discharging liquid. The outer rotor 2 of the two-dimensional motor serves as the distribution mechanism and the piston of the two-dimensional piston pump at the same time, eliminating the transmission mechanism between the motor and the piston pump, thereby making the structure more compact. By combining two independent pumps into one structure to achieve parallel outputting, the combined piston pump has a greater work-to-weight ratio. The outer rotor 2 of the two-dimensional motor does not require bearing support, thereby avoiding the problem of axial force affecting the life of the motor. The motor is a wet structure, with good heat dissipation, and it is not easy to cause sparks. The two-dimensional motor is applied to convert the rotational movement and axial movement of the rotor into magnetic coupling and decoupling, thereby reducing friction and improving efficiency. The two-dimensional piston pump structure is applied to improve volumetric efficiency.

In the embodiments, the two-dimensional motor includes two stators 1 and one outer rotor 2. The two stators 1 are co-axially arranged, abut against each other, and are symmetrically arranged. The outer rotor 2 is coaxial with the two stators 1 and sleeves the outside the stators 1. In this way, an outer rotor motor is formed.

In the embodiments, the stator 1 of the two-dimensional motor further includes a left stator 11 and a right stator 12, each of which has multi-stage shoulders. An end of the left stator 11 is arranged with a fine shaft 111. One more fine shaft 111 is arranged on the left stator 11 than the right stator 12. The fine shaft 111 has a pin slot. A small shoulder, which is hollow inside and is extending from the right stator 12, is engaged with the fine shaft 111 extending from the left stator 11.

In the embodiments, the stator 1 of the motor further includes a stator coil 13, which includes windings, a retaining bracket, a silicon steel sheet, and so on. The stator coil 13 defines a core hole 131, the core hole 131 extends through the fine shaft 111 protruding from the left stator 11 and is located between the left stator 11 and the right stator 12. The shoulders protruding from the left stator 11 and the right stator 12 attach against an end surface of the stator coil 13 to constrain the axial movement of the stator coil 13. A first positioning pin 14 is embedded in an inner ring of the stator coil 13, the pin slot of the fine shaft 111 protruding from the left stator 11, and the pin slot of the right stator 12, to constrain rotational movement of the stator coil 13, the fine shaft 111 protruding from the left stator 11, and the right stator 12.

In the embodiments, the stator coil 13 of the motor is surrounded by working liquid, such as hydraulic oil, and heat generated by heat-prone elements such as windings and silicon steel sheets during operation may be dissipated through oil cooling, resulting in higher safety when working in flammable and explosive environments.

In the embodiments, the stator 1 of the motor further includes a wire 151 and a wire 152 15. The wire 151 and the wire 152 are connected to two stator coils 13 respectively, and are connected with each other through the core hole of the stator 1. The wires are drawn out from the hole in the shaft of the left stator 11. In this way, the operation of the motor may be controlled.

In the embodiments, the outer rotor 2 of the motor further includes a flow distribution rotor 21, which is coaxial with the two stators 1 and sleeves the outside of the two stators 1. Each of two end faces of the flow distribution rotor 21 defines a pin hole. A middle of an inner surface of the flow distribution rotor 21 is arranged with a shoulder 100 in the axial direction. Each of two sides of the should defines a circular wide groove In the embodiments, the outer rotor 2 of the motor further includes permanent magnets 25. A plurality of permanent magnets 25 are fixedly received in the two circular wide grooves on the inner wall of the flow distribution rotor 21 and are spaced apart from each other. The permanent magnets 25 are arranged into two loops, disposed at the outside of the two stator coils. The width of the stator coil 13 is greater than the width of each permanent magnet 25, and an extra width at each end of the stator coil is greater than an axial travel of the rotor 2 to ensure that the stator coil 13 is present in the radial direction of the permanent magnets 25 while the rotor 2 is moving axially.

In the embodiments, the outer rotor 2 of the motor further includes a left cam 22 and a right cam 23. A side of the cam is a convex surface. The shape of the convex surface is determined according to the required period and stroke. For example, the convex surface is in a shape similar to a sine function with a 5 mm difference between the crest and trough, and the axial stroke of the rotor is ±2.5 mm. The other side of the left cam 22 and the right cam 23 is flat, and the end surfaces define pin holes. The left cam 22 and the right cam 23 are fixedly connected with the flow distribution rotor 21 through a second positioning pin 24, and the cams at both ends are mounted at 180° staggered according to the crest or trough of the convex surface.

In the embodiments, the two-dimensional piston pump includes the flow distribution rotor 21 and a pump body 3. The flow distribution rotor 21 is symmetrical about a middle face. An outer surface of the flow distribution rotor 21 defines eight grooves. Four of the eight grooves are located on a left side of the flow distribution rotor 21, and the rest four of the eight grooves are located on a right side of the flow distribution rotor 21. The four grooves on the left side of the flow distribution rotor 21 and the four grooves on the right side of the flow distribution rotor 21 are symmetrically distributed. Each groove occupies 45° in circumferential width. The four grooves on the same side overlap by a certain length in the axial direction. A set of two grooves on the left side of the flow distribution rotor 21 serve as first groove 211 and extend outward to reach the end face and cut out to obtain a radial hole. A size of the obtained radial hole, such as the size in circumferential direction, is the same width as the width of the groove. The axial width of the radial hole is 1 mm. Another set of two grooves on the left side of the flow distribution rotor 21 serve as second groove 212 and extend inward and cut the inner end face of the groove to obtain a radial hole. A size of the obtained radial hole, such as the size in circumferential direction, is the same width as the width of the groove. The axial width of the radial hole is 1 mm. A set of two grooves, which are opposite to each other and are located on the right side of the flow distribution rotor 21, serve as the third groove 213 and extend outwards to reach the end face and cuts out to obtain a radial hole. A size of the obtained radial hole, such as the size in circumferential direction, is the same width as the width of the groove. The axial width of the radial hole is 1 mm. Another set of two grooves on the right side of the flow distribution rotor 21 serve as fourth groove 214 and extend inward and cut the inner end face of the groove to obtain a radial hole. A size of the obtained radial hole, such as the size in circumferential direction, is the same width as the width of the groove. The axial width of the radial hole is 1 mm. In this way, the first volume chamber V1 and the second volume chamber V2 are communicated with the first groove 211 and the second groove 212 respectively; and the third volume chamber V3 and the fourth volume chamber V4 are communicated to the third groove 213 and the fourth groove IV 214 respectively.

In the embodiments, the pump body 3 defines four annular grooves in the circumferential direction, and the four annular grooves are symmetrical about the middle face. The four annular grooves are a first annular groove 311, a second annular groove 312, a third annular groove 313, and a fourth annular groove 314. Four evenly distributed square through holes are defined between the first annular groove 313 and the second annular groove 312. A set of two opposite through holes serve as a first through hole 321 and communicate with the first annular groove 311. Another set of two opposite through holes serve as a second through hole 322 and communicate with the second annular groove 312. Four evenly distributed through holes are defined between the third annular groove 313 and the fourth annular groove 314. A set of two opposite through holes of the four evenly distributed through holes serve as a third through hole 323 and communicate with the third annular groove 313. Another set of two opposite through holes serves as the fourth through hole 324 and communicate with the fourth annular groove 314. Each of the squared holes occupies an angle of 45° in the circumferential width. The first through hole 321 and a hole opposite to the first though hole 321 in the circumference are communicated with the first annular groove 311. The second through hole 322 and a hole opposite to the second though hole 322 in the circumference are communicated with the second annular groove 312. The third through hole 323 and a hole opposite to the third though hole 323 in the circumference are communicated with the third annular groove 313. The fourth through hole 324 and a hole opposite to the fourth though hole 324 in the circumference are communicated with the fourth annular groove 314. When the motor is operating, the flow distribution rotor 21 rotates, the slots in the flow distribution rotor 21 and the grooves in the pump body 3 are communicated with each other alternately to achieve flow distribution. The liquid is sucked in or discharged out of the volume chamber through the slots in the flow distribution rotor 21 and the annular grooves in the pump body 3.

In the embodiments, the two-dimensional piston pump includes a piston mechanism including the flow distribution rotor 21, a left cam 22, and a right cam 23. The inner diameter of the shoulder inside the middle of the flow distribution rotor 21, the inner diameter of the left cam 22, and the inner diameter of the right cam 23 are equal to each other. Inner surfaces of the flow distribution rotor 21, the left cam 22, and the right cam 23 form gap seals with corresponding engaging faces on the stator, forming the first volume chamber V1, the second volume chamber V2, the third volume chamber V3, and the fourth volume chamber V4. When the outer rotor 2 is moving axially, the outer rotor 2 functions as the piston. Sizes of the engaging faces for forming the volume chambers in the diameter direction may be adjusted, such as the inner diameter of the left cam 22 and the inner diameter of the right cam 23, to adjust the inner diameter or the outer diameter of each of the annular volume chambers. By considering peak or trough values of the cam, i.e., a travel distance of the piston, a desired volume can be achieved.

In the embodiments, the two-dimensional piston pump includes a roller assembly 4, and the roller assembly 4 further includes a roller 41 and a roller shaft 42. Four roller assemblies are arranged. Two of the four roller assemblies are symmetrically arranged in the up-down direction, and the other two the four roller assemblies are symmetrically arranged in the left-right direction. An end of the roller shaft 42 is square, and the other end is round. The squared end is inserted into a corresponding groove of the pump body 3, and the round end is inserted into a corresponding groove of the left stator 11. The surface of the roller contacts the surface of the cam.

In the embodiments, the two-dimensional piston pump includes a pump housing 5, which sleeves the outside of the pump body 3. The pump housing 5 defines a first flow channel port A1, a second flow channel port A2, a third flow channel port B1, and a fourth flow channel port B2. The first flow channel port A1 is communicated with the first annular groove 311 of the pump body 3. The second flow channel port A2 is communicated with the second annular groove 312 of the pump body 3. The third flow channel port B1 is communicated with the third annular groove 313 of the pump body 3. The fourth flow channel port B2 is communicated with the fourth annular groove 314 of the pump body 3.

In the embodiments, the two-dimensional piston pump includes a left end cover 6 and a right end cover 7, which respectively covers two sides of the pump housing 5. An inner end surface of the left end cover 6 abuts against the pump body 3, and an inner end surface of the right end cover 7 abuts against the two left stators 11. A short column protrudes from each of the inner end surface of the left end cover 6 and the inner surface of the right end cover 7. The short column of the left end cover 6 engages with the groove of the pump body 3 correspondingly. The short column of the right end cover 7 engages with the groove of the left stator 11 correspondingly. Further, the short column abuts against the roller shaft 42. In this way, the stator 1, the roller assembly 4, and the pump body 3 are fixed.

In the embodiments, for example, as shown in FIG. 4, the first through hole 321 on the pump body 3 is exactly aligned with the first groove 211 on the flow distribution rotor 21; the second through hole 322 on the pump body 3 is exactly aligned with the second groove 212 on the flow distribution rotor 21; the third through hole 323 on the pump body 3 is exactly aligned with the third groove 213 on the flow distribution rotor 21; and the fourth through hole 324 on the pump body 3 is exactly aligned with the fourth groove 214 on the flow distribution rotor 21. The outer rotor 2 is disposed at a middle position in the axial direction. The four volume chambers have an equal volume. When the outer rotor 2 rotates clockwise when being viewed from right to left, the convex surfaces of the left cam 22 and the right cam 23 interact with the roller 41. Since the roller 41 is fixed, a leftward axial force is generated on the right cam 23 to push the outer rotor of the motor 2 (i.e., the piston portion of the pump) to move axially to the left. In this way, the volume of the second volume chamber V2 and the volume of the fourth volume chamber V4 are decreased, a pressure of the second volume chamber V2 and a pressure of the fourth volume chamber V4 are increased, such that liquid in the second volume chamber V2 flows out into the second groove 212 of the flow distribution rotor 2, further flows to the second annular groove 312 through the second through hole 322 on the pump body 3, and is further discharged from the first flow channel port A1 of the pump housing 5. Liquid in the fourth volume chamber V4 flows out into the fourth groove 214 of the flow distribution rotor 2, further flows to the third annular groove 313 through the third through hole 323 on the pump body 3, and is further discharged from the second flow channel port A2 of the pump housing 5. At the same time, the volume of the first volume chamber V1 and the volume of the third volume chamber V3 are increased, a pressure of the first volume chamber V1 and a pressure of the third volume chamber V3 are decreased, such that liquid, which is intaken from the third flow channel port B1 of the pump housing 5, flows through the first annular groove 311 in the pump body 3 to flow into the first through hole 321, further flows into the first groove 211 of the flow distribution rotor 2, and is further sucked into the first volume chamber V1. Liquid, which is intaken from the fourth flow channel port B2 of the pump housing 5, flows through the fourth annular groove 314 in the pump body 3 to flow into the fourth through hole 324, further flows into the third groove 213 of the flow distribution rotor 2, and is further sucked into the third volume chamber V3.

In the embodiments, for example, as shown in FIG. 4, each of the first groove 211, the second groove 212, the third groove 213, and the fourth groove 214 on the flow distribution rotor 21 refers to a pair of grooves (the other groove is located at rear of the shown plane); and each of the first through hole 321, the second through hole 322, the third through hole 323, and the fourth through hole 324 on the pump body 3 refers to a pair of grooves (the other groove is located at rear of the shown plane). Each pair of grooves and each pair of through holes are symmetrical about the cylindrical plane. Therefore, the radial force is balanced during the suction or discharge of the liquid. When the state as shown in FIG. 4 is turned by 45°, the first through hole 321 on the pump body 3 and the first groove 211 on the flow distribution rotor 21 are changed from being completely aligned into being completely dis-communicated with each other. At this point, the rotor 2 moves to each the leftmost end. Two roller surfaces on the left contact the trough of the convex surface of the left cam 22. Two roller surfaces on the right contact the peak of the convex surface of the right cam 23. Further, the volume of the second volume chamber V2 and the volume of the fourth volume chamber V4 are reduced to zero, and the volume of the first volume chamber V1 and the volume of the third volume chamber V3 are increased and maximized. When the rotor 2 continues to rotate, the contact between the two roller surfaces on the left and the convex surface of the left cam 22 may gradually move from the trough to the peak, and the contact between the two roller surfaces on the right and the convex surface of the right cam 23 may gradually move from the peak to the trough, and the rotor 2 is subjected to an axial force to the right. At this point, the first through hole 321 on the pump housing 3 is communicated with the first groove 211 on the other side of the flow distribution rotor 21; the second through hole 322 on the pump housing 3 is communicated with the second groove 212 on the other side of the flow distribution rotor 21; the third through hole 323 on the pump housing 3 is communicated with the third groove 213 on the other side of the flow distribution rotor 21; and the fourth through hole 324 on the pump housing 3 is communicated with the fourth groove 214 on the other side of the flow distribution rotor 21. The volume of the first volume chamber V1 and the volume of the third volume chamber V3 decreases, and the volume of the second volume chamber V2 and the volume of the fourth chamber V4 increases, while the liquid is still sucked in through the third flow channel port B1 and the fourth flow channel port B2 and is discharged through the first flow channel port A1 and the third flow channel port A3, and so on, and the liquid may be sucked and discharged continuously.

The above description is only embodiments of the present disclosure and is not intended to limit the scope of the present disclosure. Any equivalent structure or equivalent process transformation made by using the contents of the description and drawings of the present disclosure, or directly or indirectly applied to other related fields of technology is similarly included in the scope of the present disclosure.

What is claimed is:

1. A two-dimensional motor combination piston pump, comprising a two-dimensional motor and a two-dimensional piston pump, wherein the two-dimensional motor and the two-dimensional piston pump are nested with each other and arranged coaxially;

the two-dimensional motor comprises two stators and one outer rotor, the two stators are distributed symmetrically, the outer rotor is coaxial with the two stators and sleeves outside of the two stators;

the two-dimensional piston pump comprises a flow distribution mechanism, the flow distribution mechanism comprises a flow distribution rotor and a pump body;

the two-dimensional piston pump comprises a piston mechanism, the piston mechanism comprises a left cam and a right cam; the left cam is fixedly connected to a left end surface of the flow distribution rotor through a second positioning pin, the right cam is fixedly connected to a right end surface of the flow distribution rotor through another second positioning pin; a middle of an inner side of the flow distribution rotor is arranged with an annular shoulder; an inner diameter of the shoulder, an inner diameter of the left cam, and an inner diameter of the right cam are equal to each other; an inner surface of the shoulder inside the flow distribution rotor, the left cam, and the right cam form gap seals with outer surfaces of a left stator and a right stator of each of the two stators to further form a first volume chamber, a second volume chamber, a third volume chamber, and a fourth volume chamber cooperatively with the flow distribution rotor;

the two-dimensional piston pump comprises a roller assembly, and the roller assembly further comprises a roller and a roller shaft, the roller assembly is fixed to an outside of the stator, the roller contacts a convex surface and a concave surface of the left cam and the right cam;

the two-dimensional piston pump comprises a pump housing, a left end cover, and a right end cover, the pump housing sleeves an outside of the pump body and defines a first flow channel port, a second flow channel port, a third flow channel port, and a fourth flow channel port, the first flow channel port is communicated with a first annular groove of the pump body, the second flow channel port is communicated with a second annular groove of the pump body, the third flow channel port is communicated with a third annular groove of the pump body, the fourth flow channel port is communicated with a fourth annular groove of the pump body; the left end cover covers a side of the pump housing, the right end cover covers an other side of the pump housing, the pump housing, the two stators, and the roller assembly are fixed engaged with each other.

2. The two-dimensional motor combination piston pump according to claim 1, wherein each of the two stators comprises a left stator, a right stator, a stator coil, a wire;

an end of the left stator is arranged with a fine shaft, the fine shaft has a pin slot;

the left stator and the right stator are co-axially arranged and are circumferentially fixed with each other;

the stator coil comprises windings, a retaining bracket and a silicon steel sheet, the stator coil defines a core hole, the core hole extends through the fine shaft and is located between the left stator and the right stator, the stator coil is coaxially and fixedly connected to the left stator and the right stator through a first positioning pin;

the wire is drawn out through a hole of the left stator.

3. The two-dimensional motor combination piston pump according to claim 1, wherein the outer rotor comprises:

the flow distribution rotor, coaxially sleeves the outside of the two stators;

a plurality of permanent magnets, wherein the plurality of permanent magnets are fixedly arranged on an inner wall of the flow distribution rotor and are spaced apart from each other; and the left cam and the right cam, wherein the left cam is fixedly connected to the left end surface of the flow distribution rotor through the second positioning pin, the right cam is fixedly connected to the right end surface of the flow distribution rotor through the another second positioning pin.

4. The two-dimensional motor combination piston pump according to claim 3, wherein the flow distribution rotor is central-symmetric;

an outer surface of the flow distribution rotor defines eight grooves, four of the eight grooves are located on a left side of the flow distribution rotor, and the other four of the eight grooves are located on a right side of the flow distribution rotor, the four grooves on the left side of the flow distribution rotor and the four grooves on the right side of the flow distribution rotor are symmetrically distributed;

each groove occupies 45° in circumferential width, the four grooves on the same side overlap by a certain length in an axial direction;

a set of two opposite grooves on the left side of the flow distribution rotor serve as a first groove, extending outward to reach an end face, another set of two opposite grooves on the left side of the flow distribution rotor serve as second groove, extending inward;

a set of two opposite grooves located on the right side of the flow distribution rotor serve as a third groove, extending outwards to reach an end face, another set of two opposite grooves on the right side of the flow distribution rotor serve as a fourth groove, extending inward.

5. The two-dimensional motor combination piston pump according to claim 1, wherein the pump body defines four annular grooves in a circumferential direction, the four annular grooves are symmetrical about a middle face, the four annular grooves are a first annular groove, a second annular groove, a third annular groove, and a fourth annular groove;

four evenly distributed through holes are defined between the first annular groove and the second annular groove, each of the four through holes occupies an angle of 45° in circumferential width;

a set of two opposite through holes of the four through holes serve as a first through hole and communicate with the first annular groove, another set of two opposite through holes of the four through holes serve as a second through hole and communicate with the second annular groove;

another four evenly distributed through holes are defined between the third annular groove and the fourth annular groove, each of the another four through holes occupies an angle of 45° in circumferential width; a set of two opposite through holes of the another four through holes serve as a third through hole and communicate with the third annular groove, and another set of two opposite through holes of the another four through holes serves as a fourth through hole and communicate with the fourth annular groove.

* * * * *